US009302756B1

(12) United States Patent
Groeschel et al.

(10) Patent No.: US 9,302,756 B1
(45) Date of Patent: Apr. 5, 2016

(54) STERN DRIVES AND FLYWHEEL HOUSINGS FOR STERN DRIVES

(71) Applicant: Brunswick Corporation, Lake Forest, IL (US)

(72) Inventors: John A. Groeschel, Theresa, WI (US); David J. Waldvogel, Font du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 73 days.

(21) Appl. No.: 14/287,888

(22) Filed: May 27, 2014

(51) Int. Cl.

| | |
|---|---|
| ***B63H 21/00*** | (2006.01) |
| ***B63H 20/24*** | (2006.01) |
| ***B63H 20/32*** | (2006.01) |
| ***F01N 13/00*** | (2010.01) |

(52) U.S. Cl.
CPC ..... *B63H 20/245* (2013.01); *B63H 20/32* (2013.01); *F01N 13/004* (2013.01)

(58) Field of Classification Search
CPC ..... B63H 20/245; B63H 20/32; F01N 13/004
USPC ..... 440/89 R; 60/272
See application file for complete search history.

(56) References Cited

U.S. PATENT DOCUMENTS

| | | | | |
|---|---|---|---|---|
| 3,116,596 | A * | 1/1964 | Voris | F01N 3/206 415/90 |
| 4,178,873 | A | 12/1979 | Bankstahl | |
| 4,526,002 | A | 7/1985 | Bibow | |
| 4,768,492 | A * | 9/1988 | Widmer | F02M 31/20 123/41.31 |
| 4,773,215 | A | 9/1988 | Winberg et al. | |
| 4,929,204 | A * | 5/1990 | Shiozawa | F02B 61/045 440/113 |
| 4,940,434 | A | 7/1990 | Kiesling | |
| 5,352,141 | A | 10/1994 | Shields et al. | |
| 5,376,034 | A | 12/1994 | Meisenburg et al. | |
| 5,735,718 | A * | 4/1998 | Ekwall | B63B 59/00 440/75 |
| 6,299,496 | B1 | 10/2001 | Griffiths et al. | |
| 6,358,109 | B1 * | 3/2002 | Neisen | F01N 13/009 440/89 B |
| 7,018,255 | B1 | 3/2006 | Phillips et al. | |
| 7,354,324 | B1 | 4/2008 | Jaszewski et al. | |
| 7,387,556 | B1 | 6/2008 | Davis | |
| 2003/0070848 | A1 * | 4/2003 | Hasegawa | B60K 17/06 180/53.1 |
| 2013/0160428 | A1 * | 6/2013 | Okuda | F01N 13/1805 60/272 |

* cited by examiner

*Primary Examiner* — Daniel V Venne
(74) *Attorney, Agent, or Firm* — Andrus Intellectual Property Law, LLP

(57) ABSTRACT

A flywheel housing is for a stern drive of a marine vessel. The flywheel housing comprises an inner mounting face for connection to an engine block of an internal combustion engine of the stern drive and an outer mounting face for connection to a gimbal housing. The inner mounting face and outer mounting face are on opposite axial sides of the flywheel housing. A conduit is formed in the flywheel housing and is configured to receive and discharge exhaust gases from the internal combustion engine. The conduit comprises an inlet port through which the exhaust gases are received from the internal combustion engine and an outlet port through which the exhaust gases are discharged from the flywheel housing.

11 Claims, 4 Drawing Sheets

STERN DRIVES AND FLYWHEEL HOUSINGS FOR STERN DRIVES

FIELD

The present disclosure relates to stern drives for marine vessels and more particularly for flywheel housings for stern drives.

BACKGROUND

The following U.S. Patents are incorporated herein by reference.

U.S. Pat. No. 4,940,434 discloses a marine propulsion device wherein a pair of generally telescoped bellows surround the universal joint and provide an exhaust passage therebetween which communicates between the inboard engine and the stern drive unit. In the embodiment disclosed herein, the inner bellows rotates with the universal joint while the outer bellows is stationary. The bellows are preferably of helical or spiral configuration and the rotating inner bellows forms an exhaust pump. In one embodiment, the bellows are concentrically disposed, while in another embodiment the bellows are eccentrically mounted.

U.S. Pat. No. 4,773,215 discloses a stern drive marine propulsion system having an inboard engine with an exhaust, an outboard drive unit operatively coupled to the engine and separated therefrom by a transom having two exhaust passages therethrough, and an exhaust control assembly aft of the engine exhaust and forward of the transom and within the boat. The assembly has an inlet connected to the engine exhaust, and has first and second outlets communicating with the respective exhaust passages extending aft through the transom. A valve in the assembly selectively controls communication of the inlet with the first outlet.

U.S. Pat. No. 4,178,873 discloses a marine stern drive including an inboard engine having an exhaust passageway connected to an outboard drive unit having an exhaust passageway. A transom bracket assembly positioned between the engine and the drive unit permits vertical pivoting of the drive unit for steering and horizontal pivoting of the drive unit for steering and horizontal pivoting of the drive unit for trimming. A first exhaust pipe is connected to the inboard engine and a second exhaust pipe is connected to the drive unit. The first exhaust pipe extends outward through the transom of the boat and has an open end position centered on and adjacent the vertical pivot axis and below the vertical pivot axis. The second exhaust pipe extends towards and ends in alignment with the end position of the first exhaust pipe to form an interface which includes an opening between the pipe ends.

U.S. Pat. No. 5,352,141 discloses a marine drive having a spool positioned in the lower horizontal bore and supporting a dual propeller shaft assembly. An exhaust passage includes a passage in the drive housing communicating with the horizontal bore at the spool, and a spool exhaust passage passing exhaust rearwardly through the spool to the propeller through-hub exhaust passages, providing through-hub exhaust through dual propellers. An oil passage in the housing communicates with the horizontal bore forwardly of the exhaust passage and lubricates the dual propeller shaft assembly.

U.S. Pat. No. 5,376,034 discloses a surfacing marine drive having a drive housing with a fore exhaust passage forward of the vertical bore housing the driveshaft, right and left exhaust passages extending rearwardly from the fore exhaust passage on opposite right and left sides of the vertical bore, and an aft exhaust passage extending rearwardly from the right and left exhaust passages and aft of the vertical bore and discharging exhaust into dual counter-rotating surface operating propellers.

U.S. Pat. No. 6,299,496 discloses an exhaust control system for a marine propulsion system used on a marine vessel. Several parameters are monitored by a controller and a controller uses the information provided by these sensors to control the position of a valve within an exhaust conduit assembly. Sound level is measured at a preselected position on the marine vessel and the degree of opening of a valve is controlled to limit the noise level emanating from the exhaust system. Some exhaust can be diverted directly to the atmosphere through the transom as long as the noise level does not exceed a preselected limit, which can typically be a state law regulation. If a noise level is exceeded, the controller forces the exhaust through an underwater discharge point, typically through the propeller hub of the marine propulsion system.

U.S. Pat. No. 7,354,324 discloses a marine propulsion system configured to be preassembled prior to the attachment of a marine engine to the marine vessel. In other words, the marine engine is attached to a transom plate, a gimbal ring, and a bell housing prior to insertion of the engine into the marine vessel. The subassembly is then moved rearwardly to cause the bell housing, gimbal ring, and portion of the transom, bracket to pass through a preformed opening in the transom. Subsequently, a transom ring is attached to the transom bracket to affix the subassembly to the transom. Then a marine drive unit is attached to the bell housing.

U.S. Pat. No. 7,018,255 discloses a marine propulsion system provided with inner and outer bellows, or tubes, which are rigidly attached to both the transom bracket and the driveshaft housing of the sterndrive system. Neither the inner nor outer tubes rotate with the driveshaft. Both the inner and outer tubes, or bellows, allow the driveshaft to rotate relative to the transom bracket about either a steering axis or trim axis. An exhaust passage is defined between the outer surface of the inner tube and the inner surface of the outer tube. This structure provides an efficient positioning of the two tubes while protecting the universal joint within the inner tube from the exhaust gases. Encompassing the inner tube within the outer tube increases the possible area that can be used for the exhaust passage in comparison to providing two individual tubes, one for the universal joint and the other as an exhaust passage.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a stern drive for a marine vessel includes an internal combustion engine, a flywheel housing located on the internal combustion engine, and a conduit formed through the flywheel housing. The conduit receives and discharges exhaust gases from the internal combustion engine. The flywheel housing can have an inner mounting face for connection to an engine block of the internal combustion and an outer mounting face for connection to a gimbal housing. The inner mounting face and outer mounting face are on opposite axial sides of the flywheel housing. The conduit includes an inlet port through which the exhaust gases are received from the internal combustion engine and an outlet port through which the exhaust gases are discharged from the flywheel housing. The inlet port can be located between the inner and outer mounting faces.

BRIEF DESCRIPTION OF THE DRAWINGS

Examples of stern drives for marine vessels and more particularly for flywheel housings for stern drives are described with reference to the following Figures. The same numbers are used throughout the Figures to reference like features and like components.

DETAILED DESCRIPTION OF THE DRAWINGS

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
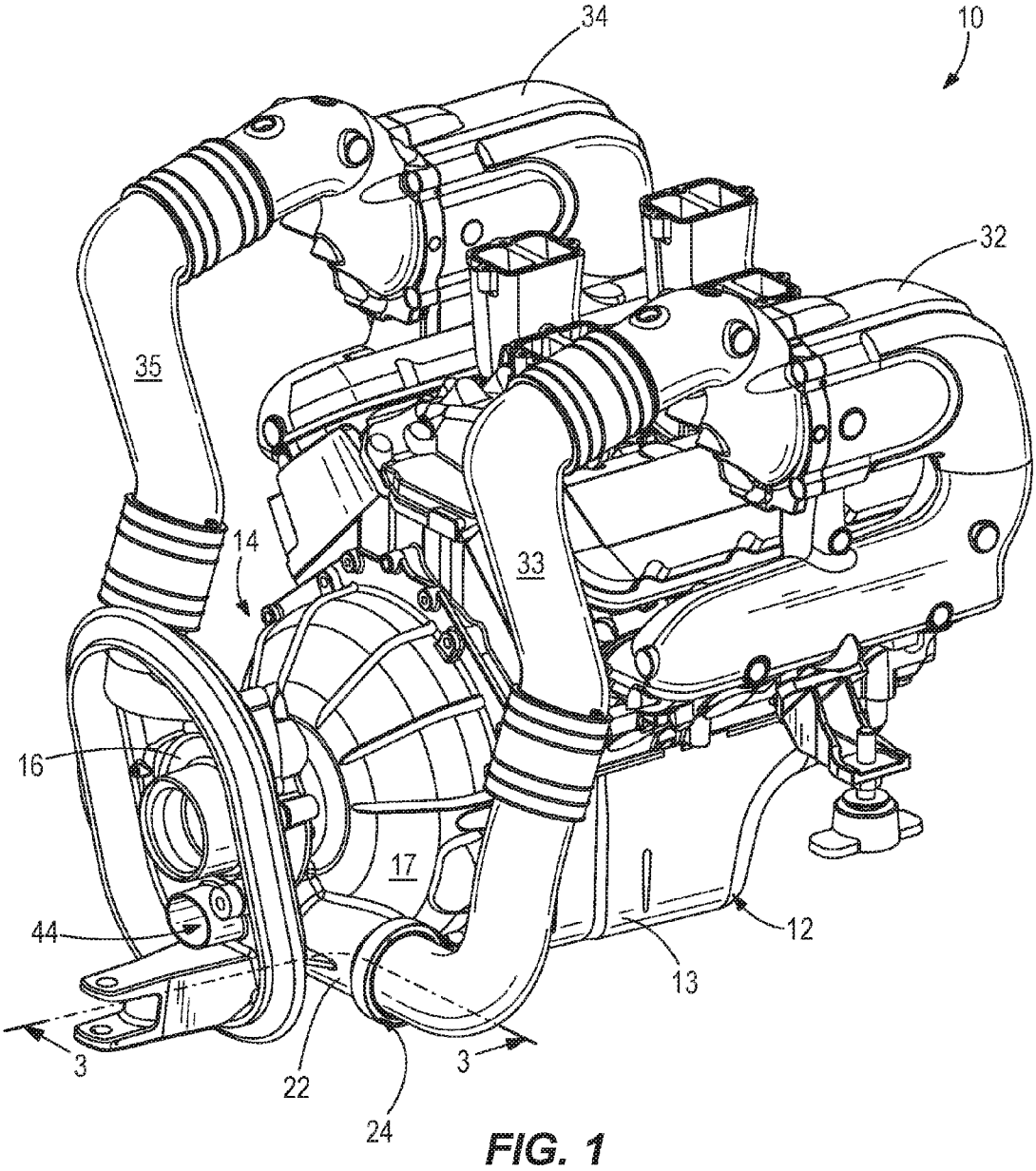
FIG. 1 is a perspective view of an internal combustion engine for implementation in a stern drive of a marine vessel.
Figure 2:
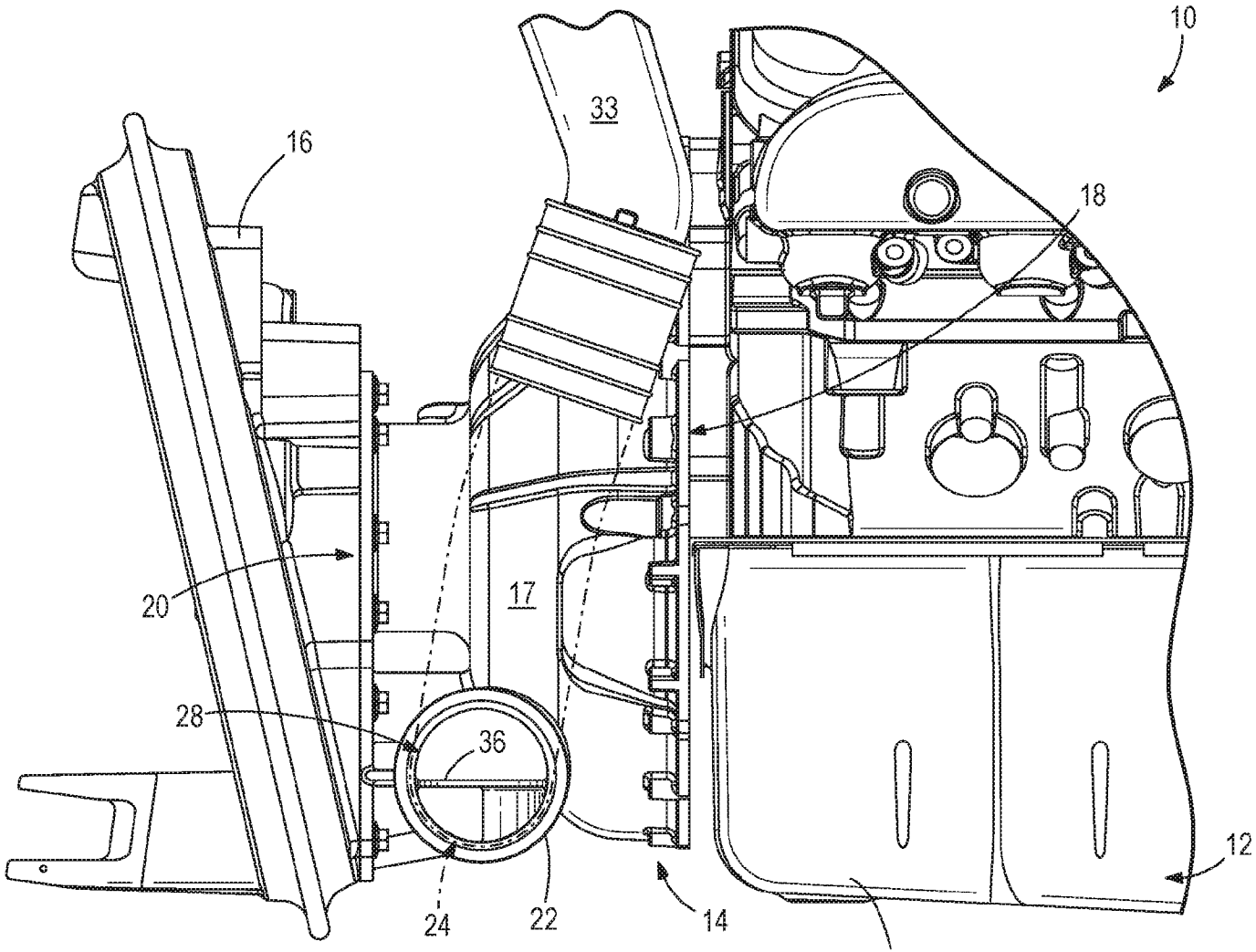
FIG. 2 is a partial side view of the apparatus in FIG. 1.
Figure 3:
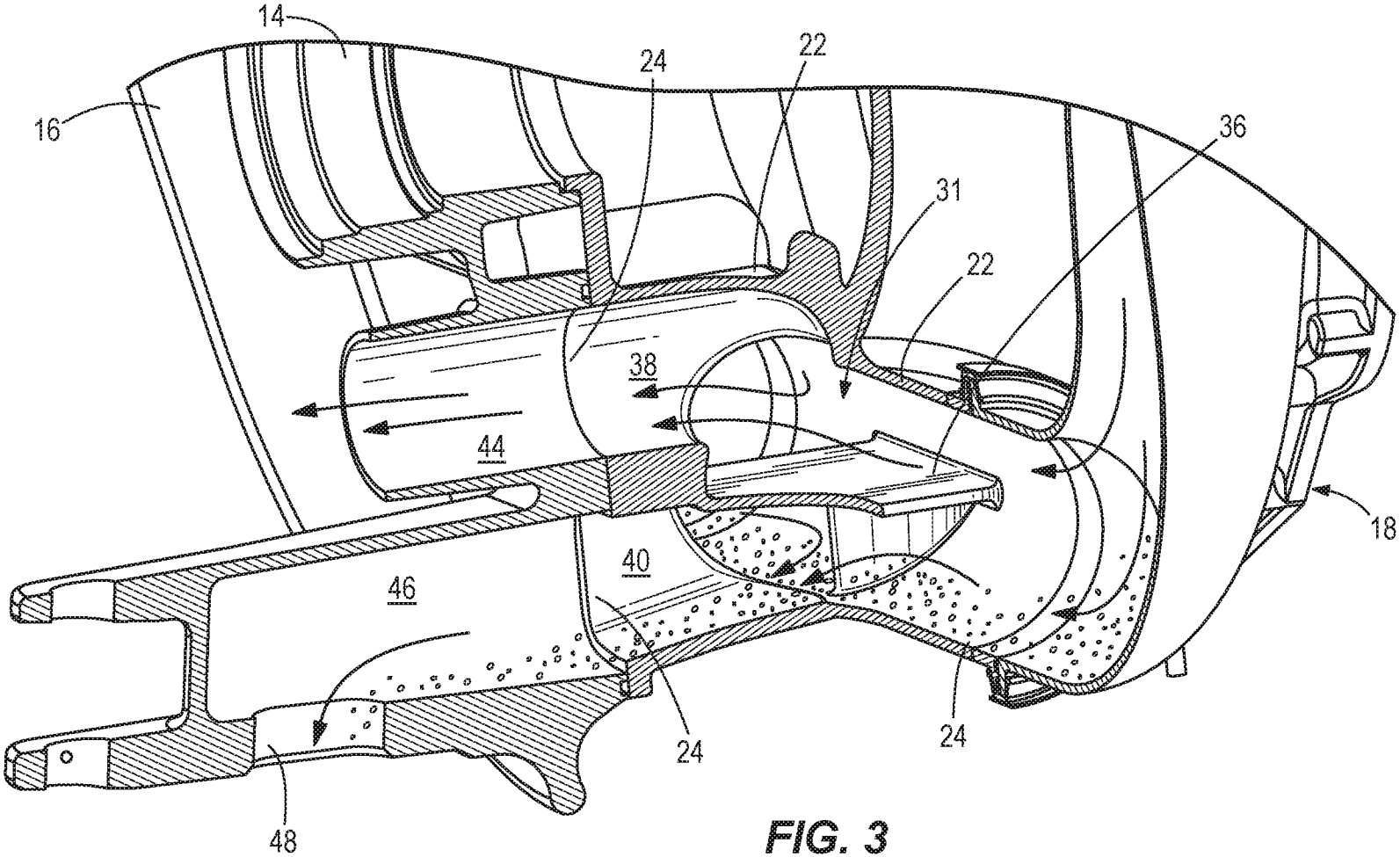
FIG. 3 is a view of section 3-3 taken in FIG. 1.
Figure 4:
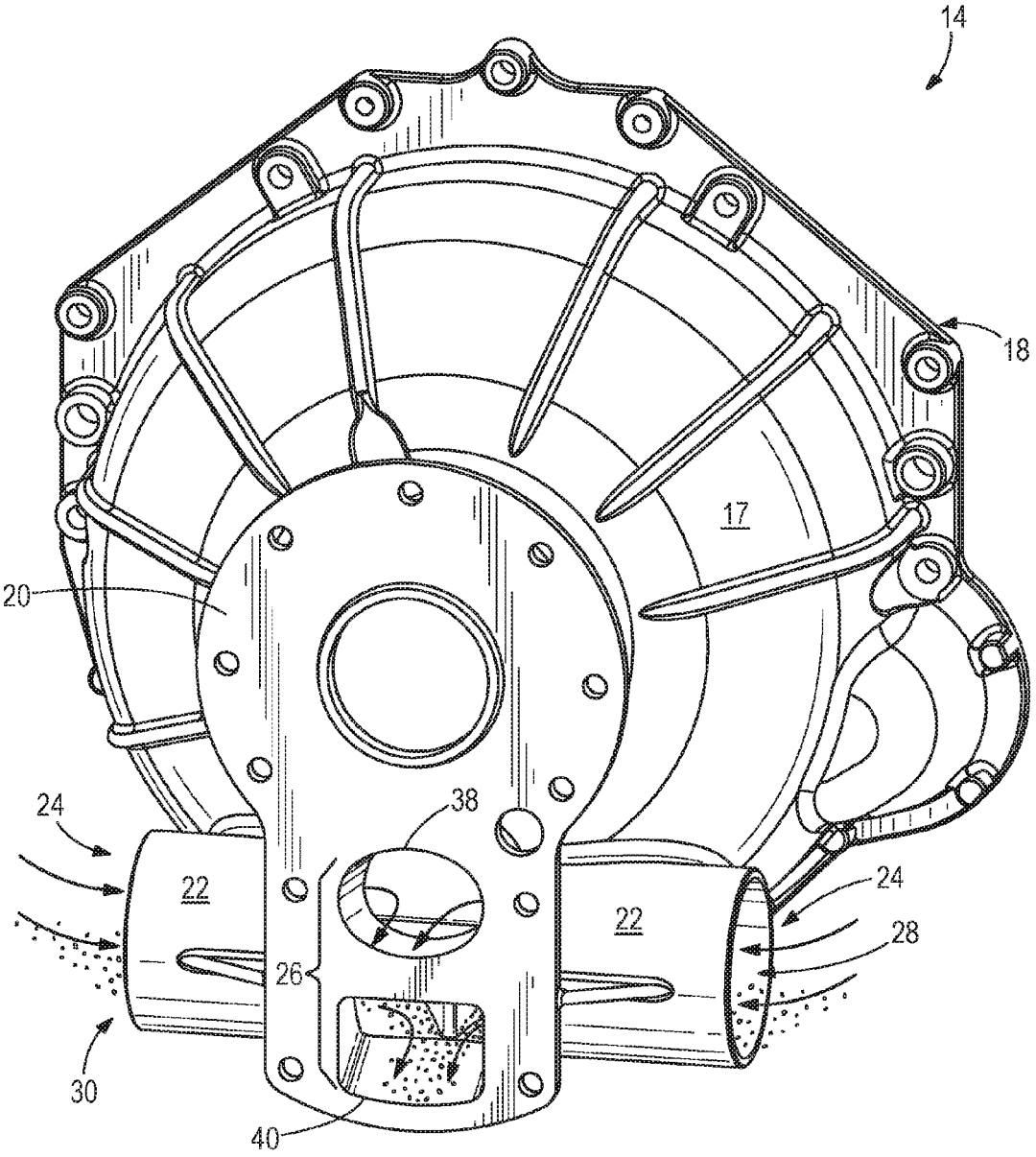
FIG. 4 is a perspective view of the flywheel housing.

FIG. 1 depicts a stern drive 10 for a marine vessel. The stern drive 10 includes an internal combustion engine 12 having an engine block 13 and a flywheel housing 14 located on the internal combustion engine 12 for housing a conventional engine flywheel (not shown). A gimbal housing 16 is connected to the flywheel housing 14 such that the flywheel and the flywheel housing 14 is located between the internal combustion engine 12 and the gimbal housing 16. As shown in FIGS. 1, 2 and 4, the flywheel housing 14 has a hemi-spherically shaped portion 17 and has a flat inner mounting face 18 that is mounted to the engine block 13 of the internal combustion engine 12 by a plurality of fasteners. The flywheel housing 14 also has a flat outer mounting face 20 that is mounted to the gimbal housing 16 by another plurality of fasteners. The inner mounting face 18 and outer mounting face 20 are disposed on axially opposite sides of the flywheel housing 14.

A conduit 22 is formed through the flywheel housing 14 and is configured to receive and discharge exhaust gases from the internal combustion engine 12. The conduit 22 directs the exhaust gases from the internal combustion engine 12 to the gimbal housing 16. The conduit 22 has at least one inlet port 24 through which the exhaust gases are received from the internal combustion engine 12 and at least one outlet port 26 through which the exhaust gases are discharged to the gimbal housing 16. The inlet port 24 is located axially between the inner and outer mounting faces 18, 20 and between the outer mounting face 20 and the hemi-spherically shaped portion 17 and the outlet port 26 is located in and extends through the outer mounting face 20.

The exact configuration of the flywheel housing 14 and the conduit 22 can vary from that which is shown. In this example, the inlet port 24 includes first and second inlets 28, 30 through which the exhaust gases are received. The first and second inlets 28, 30 are located on opposite sides of the flywheel housing 14 and are oppositely oriented with respect to each other and merge together (at 31) inside of the flywheel housing 14. A first exhaust manifold 32 is located on a first side of the internal combustion engine 12. A second exhaust manifold 34 is located on an opposite, second side of the internal combustion engine 12. The first inlet 28 receives exhaust gases from the first exhaust manifold 32 via a conduit 33 and the second inlet 30 receives exhaust gases from the second exhaust manifold 34 via a conduit 35.

A baffle 36 is disposed in the conduit 22 and is oriented and configured to separate water from the exhaust gases flowing through the conduit 22. The orientation of the baffle 36 can vary from that which is shown. In the depicted example, the baffle 36 is horizontally oriented in the conduit 22 so that water separates by centrifugal force in the conduit 22. The conduit 22 has an outlet port 26 through which the exhaust gases from both the first and second inlets 28, 30 are discharged. The outlet port 26 includes a first outlet 38 through which the exhaust gases are discharged and a second outlet 40 through which a combination of exhaust gases and water is discharged. In this example, the first outlet 38 is located higher than the second outlet 40 on the flywheel housing 14 and the baffle 36 is located between the first and second outlets 38, 40.

The gimbal housing 16 is attached to the outer mounting face 20 of the flywheel housing 14. The gimbal housing 16 includes a first passage 44 that aligns with and receives exhaust gases from the first outlet 38 in the flywheel housing 14 and a second passage 46 that aligns with and receives the combination of exhaust gases and water from the second outlet 40 in the flywheel housing 14. A drain 48 is formed in the second passage 46 and operates to discharge water and exhaust gases from the stern drive 10. The first passage 44 is connected to and ultimately discharges the exhaust gases from the stern drive 10 through a propeller housing connected to the gimbal housing 16.

Advantageously, the exhaust components shown can be installed onto the stern drive and internal combustion engine prior to the entire package being installed on a marine vessel. The exhaust inlet can be made much larger than conventional arrangements to thereby accommodate larger displacement gas or diesel engines. Adding the exhaust component to the flywheel housing allows for the exhaust connection to be moved towards the internal combustion engine and provides clearance necessary to place the gimbal housing in the space where the exhaust connection conventionally resides.

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims.

What is claimed is:

1. A stern drive for a marine vessel, the stern drive comprising an internal combustion engine, a flywheel housing located on the internal combustion engine, and a conduit formed through the flywheel housing, wherein the conduit receives and discharges exhaust gases from the internal combustion engine;

a gimbal housing, wherein the flywheel housing is located between the internal combustion engine and the gimbal housing, and wherein the conduit directs the exhaust gases from the internal combustion engine to the gimbal housing;

wherein the flywheel housing comprises an inner mounting face that is mounted to an engine block of the internal combustion engine and an outer mounting face that is mounted to the gimbal housing, wherein the inner mounting face and outer mounting face are on axially opposite sides of the flywheel housing; and wherein conduit comprises an inlet port through which the exhaust gases are received from the internal combustion engine and an outlet port through which the exhaust gases are discharged to the gimbal housing, wherein the inlet port is located between the inner and outer mounting faces and wherein the outlet port is located in the outer mounting face.

2. The stern drive according to claim 1, wherein inlet port comprises first and second inlets through which the exhaust gases are received.

3. The stern drive according to claim 2, wherein the first and second inlets are located on opposite sides of the flywheel housing.

4. The stern drive according to claim 3, wherein the first and second inlet ports are oppositely oriented with respect to each other.

5. The stern drive according to claim 4, further comprising a first exhaust manifold located on a first side of the internal combustion engine and a second exhaust manifold located on an opposite, second side of the internal combustion engine, wherein the first inlet receives exhaust gases from the first exhaust manifold and wherein the second inlet receives exhaust gases from the second exhaust manifold.

6. A stern drive for a marine vessel, the stern drive comprising an internal combustion engine, a flywheel housing located on the internal combustion engine, and a conduit formed through the flywheel housing, wherein the conduit receives and discharges exhaust gases from the internal combustion engine:

a baffle located in the conduit, wherein the baffle separates water from the exhaust gases;

wherein the conduit comprises an outlet port through which the exhaust gases are discharged, the outlet port comprising a first outlet through which exhaust gas is discharged and a second outlet through which a combination of exhaust gas and water is discharged; and wherein the baffle is horizontally oriented in the conduit and wherein the first outlet is located higher than the second outlet on the flywheel housing.

7. The stern drive according to claim 6, wherein the flywheel housing comprises a hemi-spherically shaped portion and wherein the inlet port is located between the hemi-spherically shaped portion and the outer mounting face.

8. The stern drive according to claim 6, comprising a gimbal housing attached to the outer mounting face of the flywheel housing, wherein the gimbal housing comprises a first passage receiving exhaust gases from the first outlet in the flywheel housing and a second passage receiving exhaust gases and water from the second outlet in the flywheel housing.

9. The stern drive according to claim 8, comprising a drain in the second passage, wherein the drain discharges the water from the stern drive.

10. The stern drive according to claim 8, comprising a propeller housing, wherein the first passage discharges the exhaust gases from the stern drive through the propeller housing.

11. The stern drive according to claim 1, wherein the flywheel housing comprises a hemi-spherically shaped portion and wherein the inlet port is located between the hemi-spherically shaped portion and the outer mounting face.

* * * * *